US008807856B2

(12) United States Patent
Sodeyama

(10) Patent No.: US 8,807,856 B2
(45) Date of Patent: Aug. 19, 2014

(54) TAPE CUTTER AND TAPE PRINTER INCLUDING THE SAME

(71) Applicant: Seiko Epson Corporation, Tokyo (JP)

(72) Inventor: Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 13/645,817

(22) Filed: Oct. 5, 2012

(65) Prior Publication Data

US 2013/0094890 A1 Apr. 18, 2013

(30) Foreign Application Priority Data

Oct. 12, 2011 (JP) ..... 2011-224718

(51) Int. Cl.
*B41J 11/70* (2006.01)
*B26D 7/02* (2006.01)
*B26D 1/06* (2006.01)

(52) U.S. Cl.
CPC ..... *B26D 7/025* (2013.01); *B26D 1/065* (2013.01); *B41J 11/703* (2013.01)
USPC ..... 400/621; 83/282

(58) Field of Classification Search
CPC ..... B41J 11/66; B41J 11/70; B26D 7/02
USPC ..... 400/621
See application file for complete search history.

(56) References Cited

U.S. PATENT DOCUMENTS 4,358,979 A * 11/1982 Kurzbuch ..... 83/658
5,235,887 A * 8/1993 Moriya ..... 83/282
6,602,009 B2 * 8/2003 Sodeyama ..... 400/621
7,428,859 B2 * 9/2008 Fujita et al. ..... 83/456
2008/0298872 A1 * 12/2008 Kubota et al. ..... 400/621
2009/0245915 A1 * 10/2009 Kawaguchi ..... 400/621
2011/0139065 A1 * 6/2011 Kosuge ..... 118/37

FOREIGN PATENT DOCUMENTS

JP 04099668 A * 3/1992 ..... B41J 11/66
JP 04099669 A * 3/1992 ..... B41J 11/66
JP 09314938 A * 12/1997 ..... B41J 11/66
JP 2003-237155 A 8/2003
JP 2008036805 A * 2/2008 ..... B41J 11/70
JP 2008194870 A * 8/2008 ..... B41J 11/70
JP 2010082817 A * 4/2010 ..... B41J 11/70
JP 2010099852 A * 5/2010 ..... B41J 11/70

* cited by examiner

*Primary Examiner* — Nguyen Ha

(74) *Attorney, Agent, or Firm* — ALG Intellectual Property, LLC

(57) ABSTRACT

A tape cutter including: a cutter for cutting a tape-shaped material; a cutter frame for supporting the cutter in such a condition that the cutter can carry out cutting; a cutter driving mechanism for allowing the cutter to perform cutting from a standby position to a cutting position; a tape pressing member for pressing the tape-shaped material in a cutting direction against a receiving member provided on the cutter frame prior to the cutting by the cutter; a pressing spring disposed between the cutter and the tape pressing member to urge the cutter and the tape pressing member in directions away from each other; and a return spring whose one urging end is hooked to the tape pressing member to return the cutter from the cutting position to the standby position by returning the tape pressing member.

6 Claims, 7 Drawing Sheets

TAPE CUTTER AND TAPE PRINTER INCLUDING THE SAME

CROSS-REFERENCE

The entire disclosure of Japanese Patent Application No. 2011-224718 filed on Oct. 12, 2011, which is hereby incorporated by reference in its entirety.

BACKGROUND

A tape cutter for cutting a printed portion of a band-shaped printing tape is known (see JP-A-2003-237155).

This type of tape cutter includes a slide cutter which cuts the printing tape, a cutter driving mechanism which allows the slide cutter to carry out cutting, a tape pressing member which presses the printing tape against a receiving member provided on a cutter frame prior to the cutting by the slide cutter, a coil spring disposed between the slide cutter and the tape pressing member to urge the cutter and the tape pressing member in directions away from each other, and a return spring whose one urging end is hooked to the slide cutter to return the slide cutter from a cutting position to a standby position.

Upon the start of the cutting by the slide cutter with the aid of the cutter driving mechanism, the tape pressing member shifts together with the slide cutter to press the printing tape. In this condition, the slide cutter further shifts while compressing the coil spring, and cuts the printing tape. After the cut of the printing tape, the return spring starts returning action to shift the slide cutter toward the standby position along with expansion of the coil spring. With further shift of the sliding cutter, the tape pressing member comes into engagement with the slide cutter, and returns to an original standby position together with the slide cutter.

According to the known tape cutter having this structure, the cutter driving mechanism shifts the slide cutter (and the tape pressing member) in the cutting direction while resisting the forces of the return spring and the coil spring. In this case, the cutter driving mechanism drives the slide cutter to allow the cutting operation by the cutter while resisting practically two spring forces of the return spring functioning as a tension spring and the coil spring functioning as a compression spring, the two springs of which are connected in parallel with each other. Thus, an output torque of a power source (motor) of the cutter driving mechanism is set large enough to resist the two spring forces of the springs connected in parallel with each other and the cutting resistance produced by the slide cutter. This condition increases the size of the power source (motor), or requires a rigid power transmission system as well as a complicated gear train.

SUMMARY

An advantage of some aspects of the invention is to provide a tape cutter capable of driving a cutter by a relatively small torque, and a tape printer including this tape cutter.

A tape cutter according to an aspect of the invention includes: a cutter which cuts a tape-shaped material; a cutter frame which supports the cutter in such a condition that the cutter can carry out cutting; a cutter driving mechanism which allows the cutter to perform cutting from a standby position to a cutting position; a tape pressing member which presses the tape-shaped material in a cutting direction against a receiving member provided on the cutter frame prior to the cutting by the cutter; a pressing spring disposed between the cutter and the tape pressing member to urge the cutter and the tape pressing member in directions away from each other; and a return spring whose one urging end is hooked to the tape pressing member to return the cutter from the cutting position to the standby position by returning the tape pressing member.

According to this structure, the return spring is attached to the tape pressing member such that the return spring and the pressing spring are joined in series with each other on the cutter driving mechanism. This structure not only reduces the length (stroke) of the return spring but also achieves relative decrease in an output torque of the cutter driving mechanism required in the cutting operation by the cutter. In the step of returning the cutter, the pressing spring initially returns the cutter, and the return spring finally returns the cutter and the tape pressing member to the standby position. Thus, the returning action takes place without producing any problem. The cutter employed in this structure may be either a slide cutter or a scissors-type cutter. The types of the return spring and the pressing spring may be arbitrarily selected.

In this case, it is preferable that the cutter includes a cutter blade, and a cutter holder which holds the cutter blade while supported by the cutter frame in such a condition as to freely slide in the cutting direction.

According to this structure, the cutter is constituted by the slide cutter which has a thin cutter blade producing small cutting resistance. Thus, the output torque of the cutter driving mechanism can further decrease. It is preferable that the cutter blade is so constructed as to be freely attachable to and detachable from the cutter holder (as a replaceable component).

In this case, it is preferable that the tape pressing member is supported by the cutter holder in such a condition as to freely slide in the cutting direction.

According to this structure, the tape pressing member slides prior to the cutting of the tape-shaped material by the cutter blade at the start of the cutting, and holds the tape-shaped material between the tape pressing member and the receiving member to fix the tape-shaped material therebetween. Thus, the cutting of the tape-shaped material can be stabilized.

A tape printer according to another aspect of the invention includes: the tape cutter according to the above aspect; and a printing unit disposed on the upstream side in the feed direction of the tape-shaped material with respect to the tape cutter to perform printing on the tape-shaped material.

According to this structure, the output torque of the cutter driving mechanism included in the tape printer decreases. This advantage contributes to reduction of the cost and size of the tape printer.

BRIEF DESCRIPTION OF THE DRAWINGS

The invention will be described with reference to the accompanying drawings, wherein like reference numbers reference like elements.

DESCRIPTION OF EXEMPLARY EMBODIMENT

A tape printer according to an embodiment of the invention is hereinafter described with reference to the accompanying drawings. This tape printer prints desired characters, figures and the like on a printing tape (tape-shaped material) while drawing the printing tape from a tape cartridge containing the printing tape and detachably attached to the tape printer, and cuts a printed portion of the printing tape into a piece having a predetermined length to produce a label.

Figure 1:
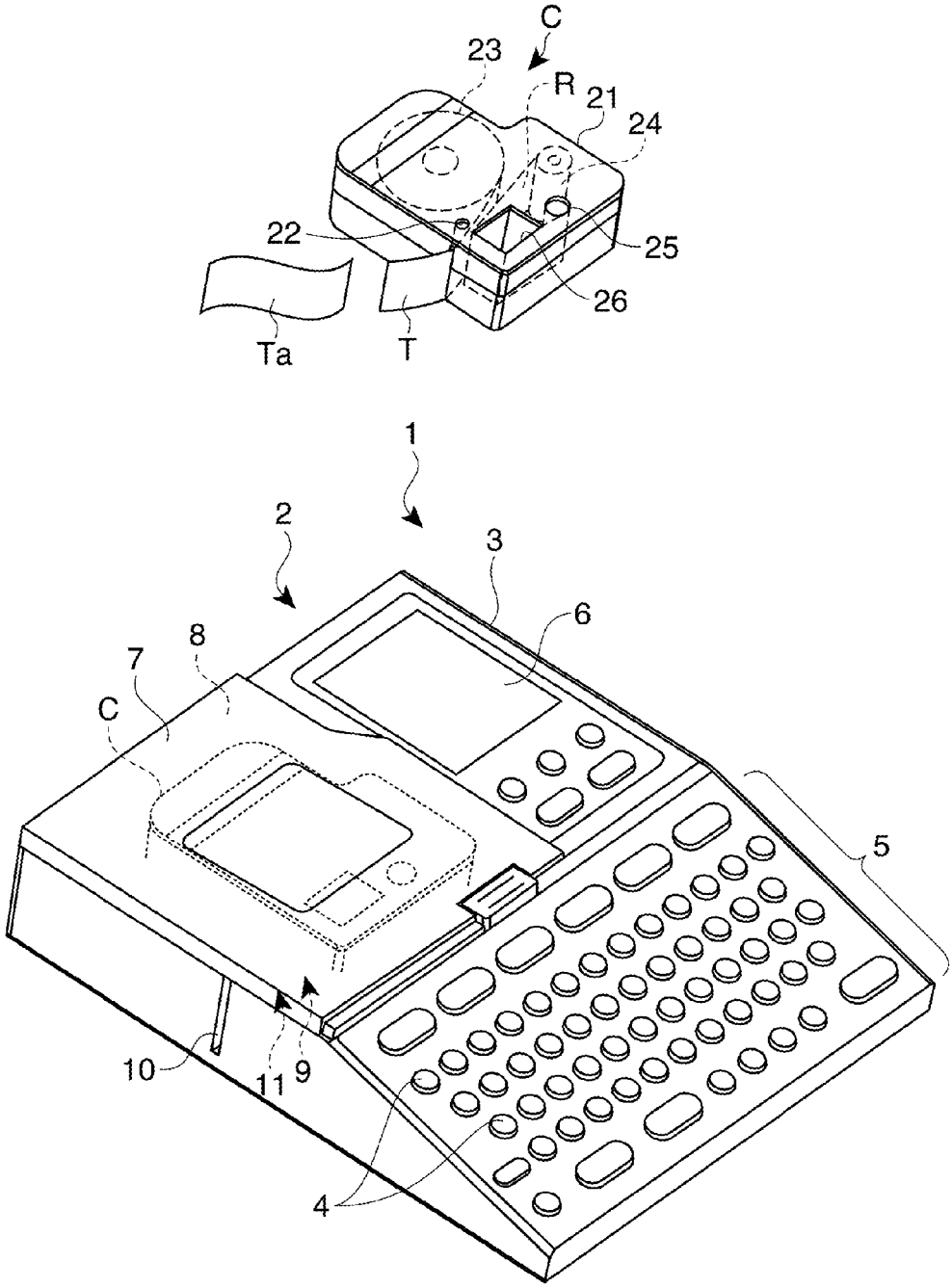
FIG. 1 illustrates the entire perspective view of a tape printer according to an embodiment of the invention from which a tape cartridge is removed.

FIG. 1 illustrates the external appearance of the tape printer. As can be seen from the figure, a tape printer 1 includes a device main body 3 whose outer casing is constituted by a device case 2, and a tape cartridge C detachably attached to the device main body 3. The tape cartridge C houses a printing tape T as a printing target to which a released tape is attached, and holds the printing tape T in such a condition that the printing tape T can be drawn from the tape cartridge C.

A key input unit 5 having various types of input keys 4 is provided on the front half of the upper surface of the device case 2. A liquid crystal display 6 for displaying input results and others received from the key input unit 5 is provided on the right part of the rear half of the upper surface of the device case 2. An opening and closing cover 7 is disposed on the left part of the rear half of the upper surface of the device case 2. A cartridge attachment portion 8 to which the tape cartridge C is detachably attached is formed inside the opening and closing cover 7. A printing head 9 is provided on the left part of the interior of the device case 2. A tape outlet port 10 communicating with the cartridge attachment portion 8 is formed on the left side of the device case 2 as an opening through which a printing tape Ta after printing is discharged. A tape cutting mechanism (tape cutting unit) 11 which makes reciprocating sliding movement for cutting the printing tape T is equipped within the device case 2 in the vicinity of the tape outlet port 10. The details of the tape cutting mechanism 11 will be described later.

The tape cartridge C contains the printing tape T, an ink ribbon R, and a platen 22 within a cartridge case 21 constituted by upper and lower cases. The printing tape T wound around a tape reel 23, and the ink ribbon R wound around a ribbon draw-out reel 24 and a ribbon winding reel 25 are accommodated within the cartridge case 21 in such a condition as to freely rotate. The platen 22 is also accommodated within the cartridge case 21 in a position adjacent to a head insertion opening 26 in such a condition as to freely rotate. The printing tape T drawn from the tape reel 23, and the ink ribbon R drawn from the ribbon draw-out reel 24 travel side by side along the head insertion opening 26 while overlapping with each other. Then, the printing tape T is forwarded toward the outside of the cartridge case 21, whereas the ink ribbon R is wound around the ribbon winding reel 25. In the area where the printing tape T and the ink ribbon R travel side by side, the platen 22 and the printing head 9 face to the printing tape T and the ink ribbon R sandwiched between the platen 22 and the printing head 9, and carry out printing thereat. The printing tape Ta produced after printing is discharged to the outside. The tape cartridge C is selected from plural types of tape cartridges having different tape widths.

Figure 2:
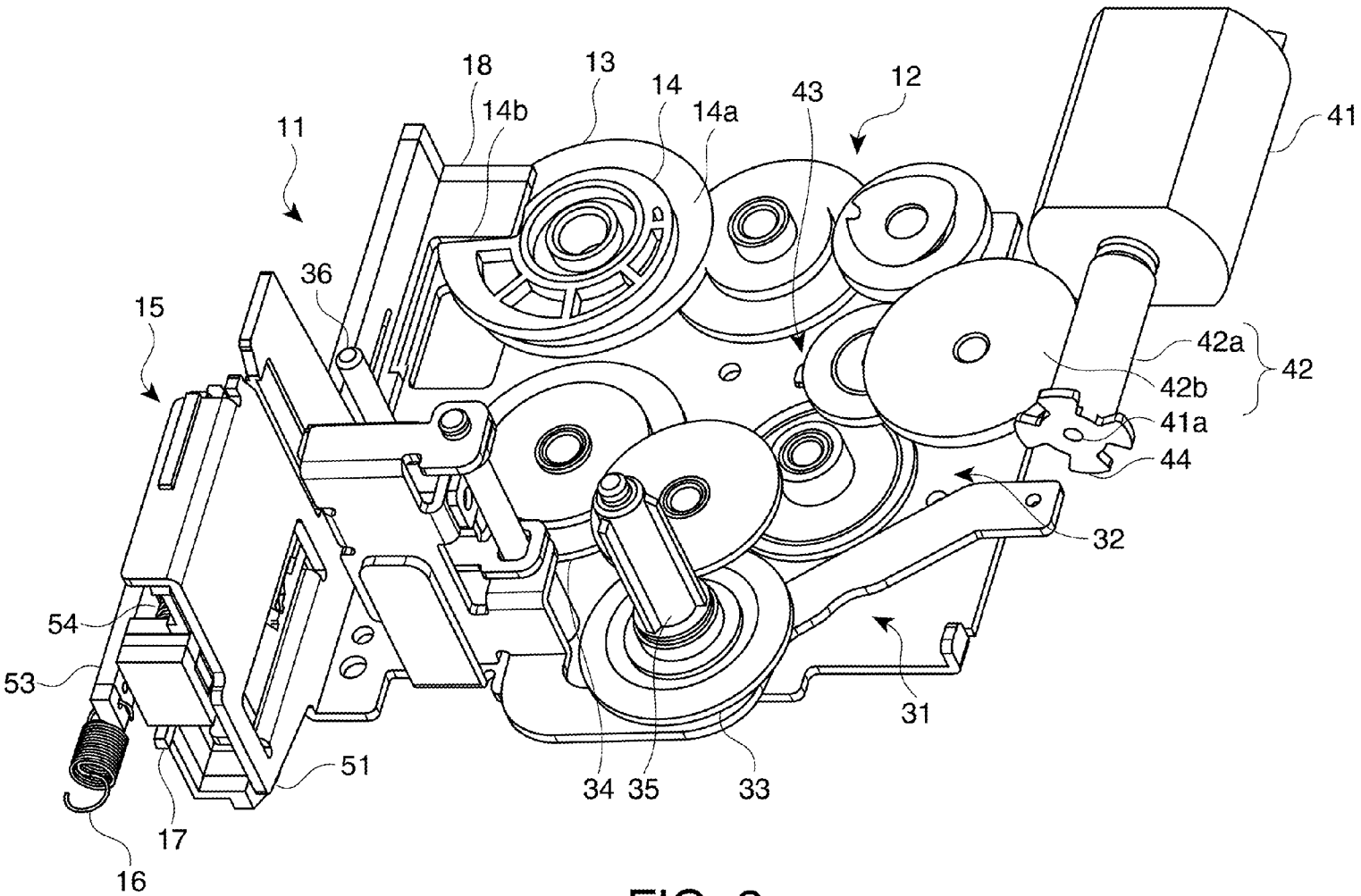
FIG. 2 is a perspective view illustrating the entire structure of a tape cutting mechanism.

The details of the tape cutting mechanism 11 and a tape feed mechanism 31 included in the tape printer 1 according to this embodiment are now explained with reference to FIG. 2. The tape cutting mechanism 11 and the tape feed mechanism 31 are driven by a driving motor 41 as a common driving source. The tape feed mechanism 31 operates by the normal rotation of the driving motor 41, while the tape cutting mechanism 11 operates by the reverse rotation of the driving motor 41. Thus, the tape cutting mechanism 11 and the tape feed mechanism 31 are driven by the single driving motor 41.

A worm 42*a* fixed to a main shaft 41*a* of the driving motor 41 engages with a worm wheel 42*b*. The worm wheel 42*b* engages with a clutch mechanism 43 (clutch gear mechanism). The normal and reverse rotational forces of the driving motor 41 are converted into a tape feeding action (including printing operation) and a tape cutting action via a worm and worm wheel 42 (worm 42*a* and worm wheel 42*b*) and the clutch mechanism 43. The figure further shows a pulse disk 44 fixed to the tip of the main shaft 41*a* of the driving motor 41. This pulse disk 44 and a not-shown photo-interrupter constitute an encoder.

The tape feed mechanism 31 has the driving motor 41 and a feed gear train (reduction gear train) 32 including the worm and worm wheel 42 and the clutch mechanism 43. Two output gears 33 and 34 of the feed gear train 32 rotatably equipped on the back side of the cartridge attachment portion 8 rotate a ribbon winding driving shaft 35 and the platen 22. More specifically, in response to the normal rotation of the driving motor 41, the clutch mechanism 43 connects with the feed gear train 32, whereby the power of the driving motor 41 is transmitted to the ribbon winding driving shaft 35 and the platen 22 to rotate these components 35 and 22.

Similarly, the tape cutting mechanism 11 has the driving motor 41, a drive gear train (reduction gear train) 12 including the worm and worm wheel 42 and the clutch mechanism 43, a cutting cam 14 fixed coaxially with a final gear 13 of the drive gear train 12, and a slide cutter 15 which performs cutting by the movement of the cutting cam 14. The tape cutting mechanism 11 further includes a return spring 16 which returns the slide cutter 15 to a standby position, and a detection switch 17 provided on a circuit board to detect the return of the slide cutter 15 to the standby position. Thus, the driving motor 41, the drive gear train 12, and the cutting cam 14 constitute a cutter driving mechanism which allows cutting by the slide cutter 15.

The cutting cam 14 is constituted by a so-called plate cam whose cam curve (profile) is formed by a combination of a substantially spiral returning portion 14*a*, and a linear cutting portion 14*b* connecting both ends of the returning portion 14*a*. The returning portion 14*a* extends in a spiral shape which makes substantially one round. The cutting portion 14*b* extends substantially in the radial direction. Before the start of the cutting, the cutting portion 14*b* engages with an engaging projection 18 of the slide cutter 15.

A tape pressing member 53 is provided in the vicinity of the tape outlet port 10 to press the printing tape T against a tape receiving member 52 (described later) equipped on a cutter frame 51 for fixation of the printing tape T. A coil spring (pressing spring) 54 provided between the tape pressing member 53 and the slide cutter 15 urges these components 53 and 15 in directions away from each other. The return spring 16 provided on the tape pressing member 53 is attached in such a condition that one urging end of the return spring 16 is hooked to the tape pressing member 53. The other urging end of the return spring 16 is hooked to the interior of the device case 2.

Figure 4:
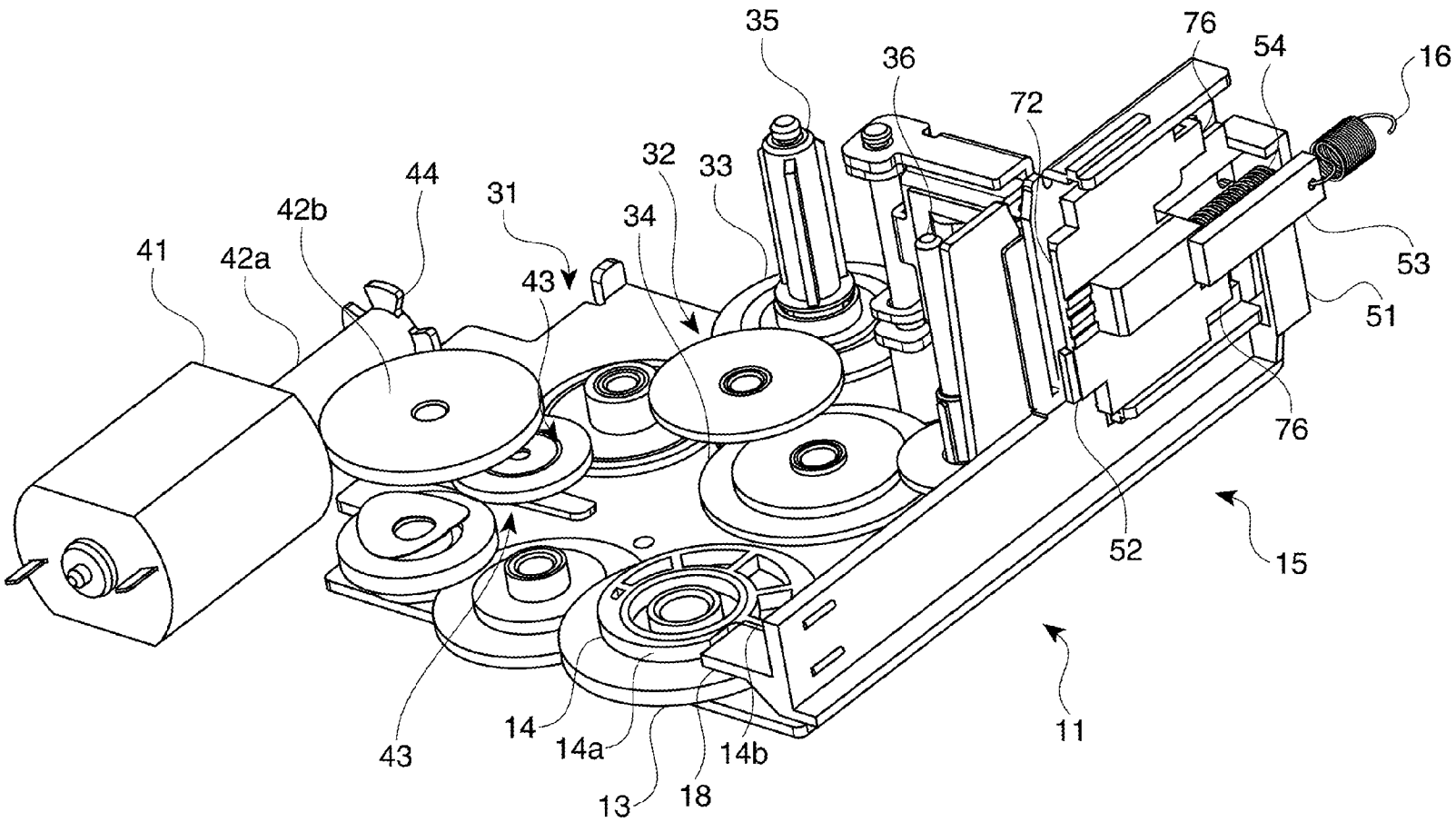
FIG. 4 is a perspective view illustrating the entire structure of the tape cutting mechanism when a tape pressing member presses a tape receiving member.
Figure 5:
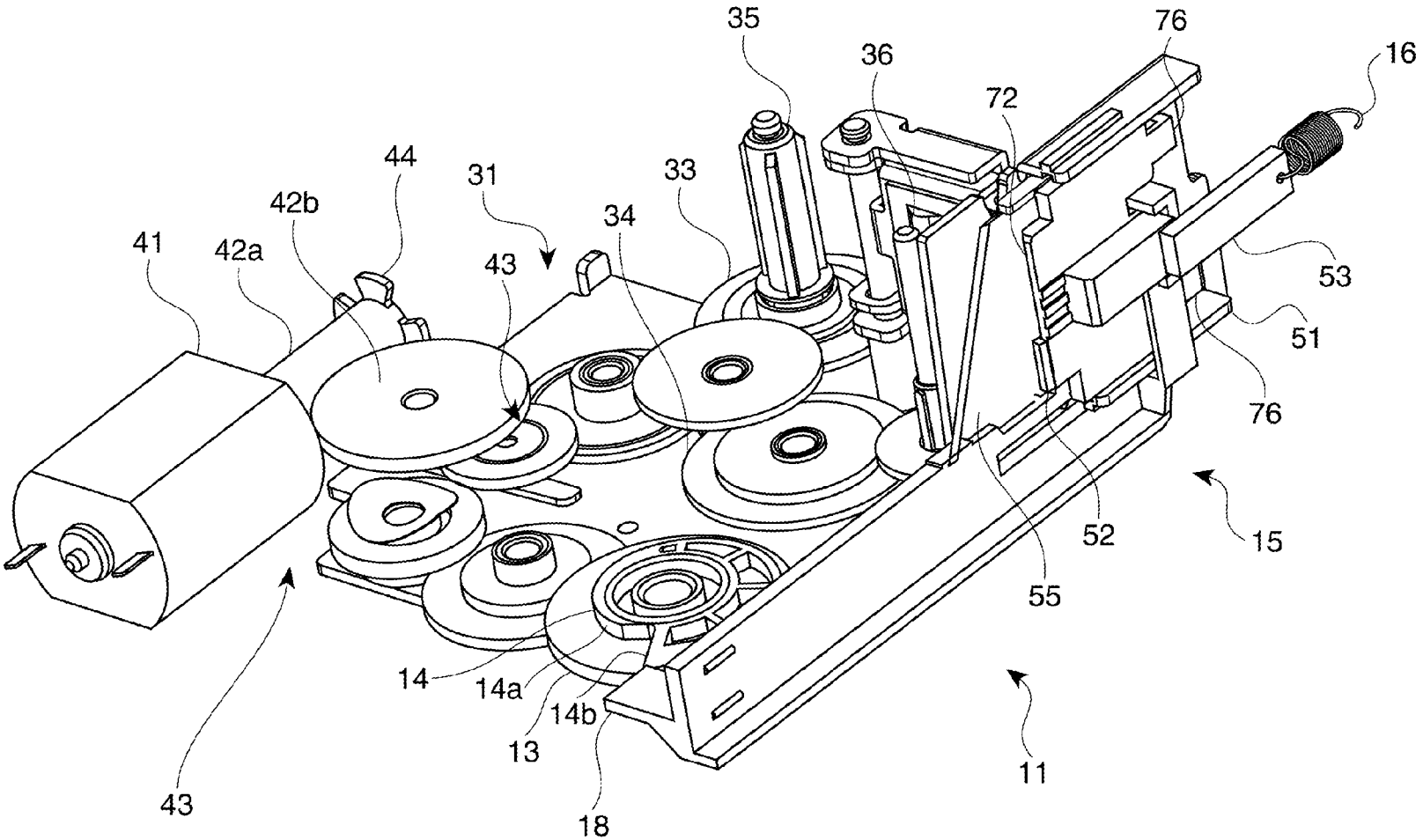
FIG. 5 is a perspective view illustrating the entire structure of the tape cutting mechanism when a cutter blade is located at a cutting position.

The cutting operation for cutting the printing tape T performed by the tape cutting mechanism is now explained with reference to FIGS. 3 through 5.

Figure 3:
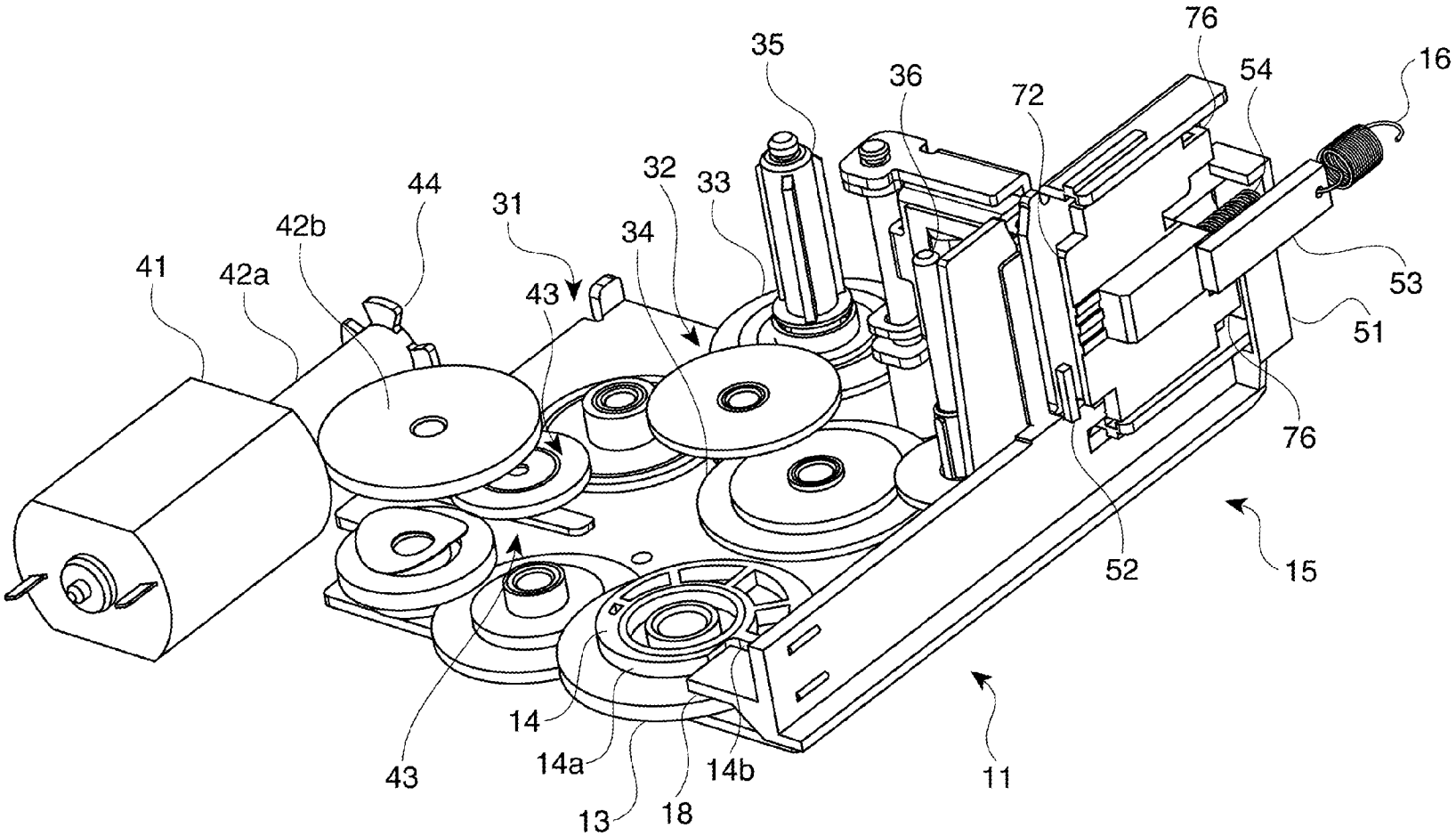
FIG. 3 is a perspective view illustrating the entire structure of the tape cutting mechanism at a standby position.

In the initial condition shown in FIG. 3, the root of the cutting portion 14*b* of the cutting cam 14 contacts the engaging projection 18 of the slide cutter 15. When the cutting cam 14 in this condition starts rotation, the tape pressing member 53 is drawn in the direction from the rear toward the front while resisting the spring force of the return spring 16 to reach a position pressing the tape receiving member 52 (see FIG. 4). Then, a cutter blade 55 (described later) cuts the printing tape T by draw cut while further resisting the spring force of the coil spring 54 (see FIG. 5).

With further rotation of the cutting cam 14, a contact portion of the engaging projection 18 shifts from the cutting portion 14*b* to the spiral returning portion 14*a*, whereby the slide cutter 15 slowly returns to the standby position by the spring force of the coil spring 54 and then the spring force of the return spring 16.

Figure 6A:
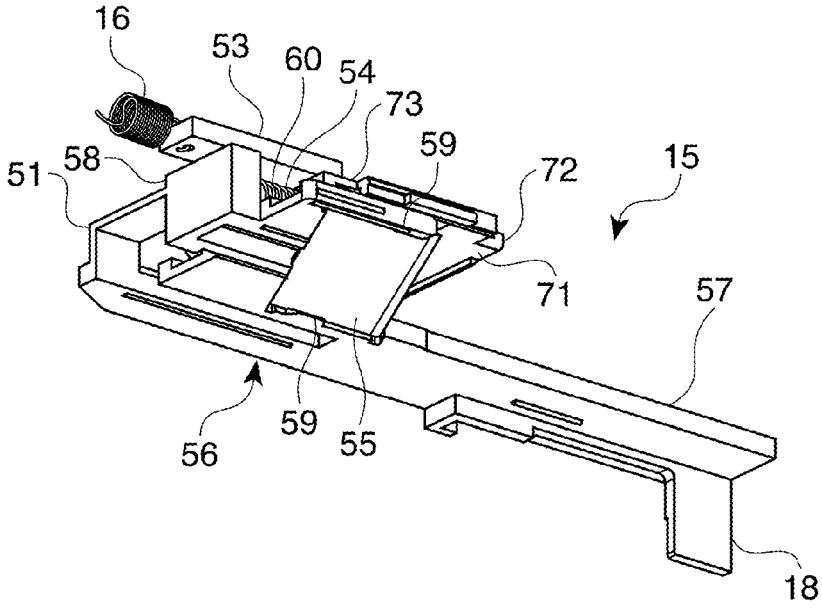
FIG. 6A is a perspective view of a slide cutter as viewed from the inside.
Figure 6B:
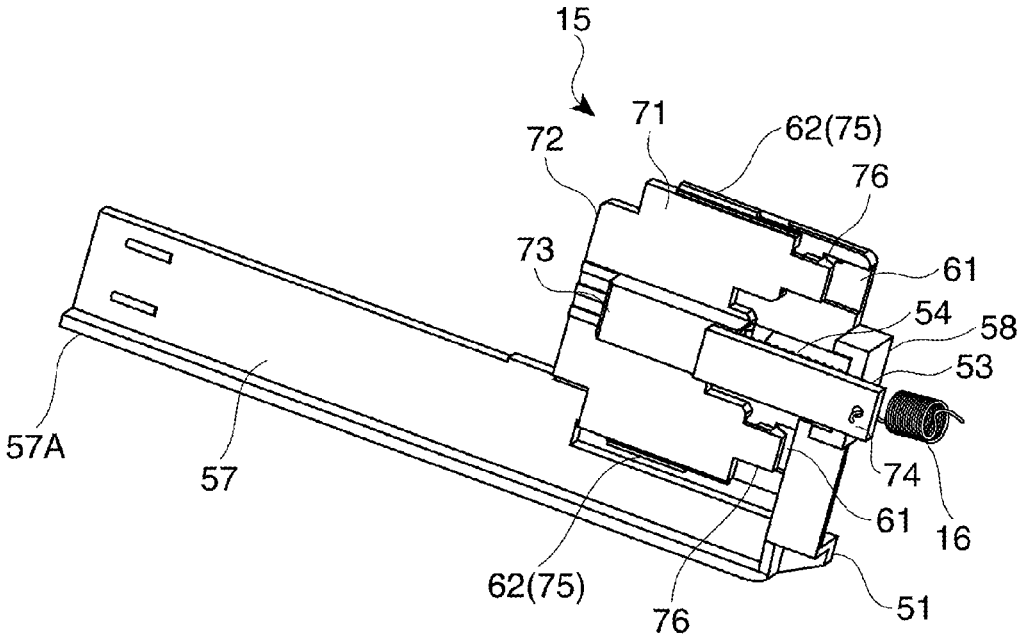
FIG. 6B is a perspective view of the slide cutter as viewed from the outside.
Figure 7:
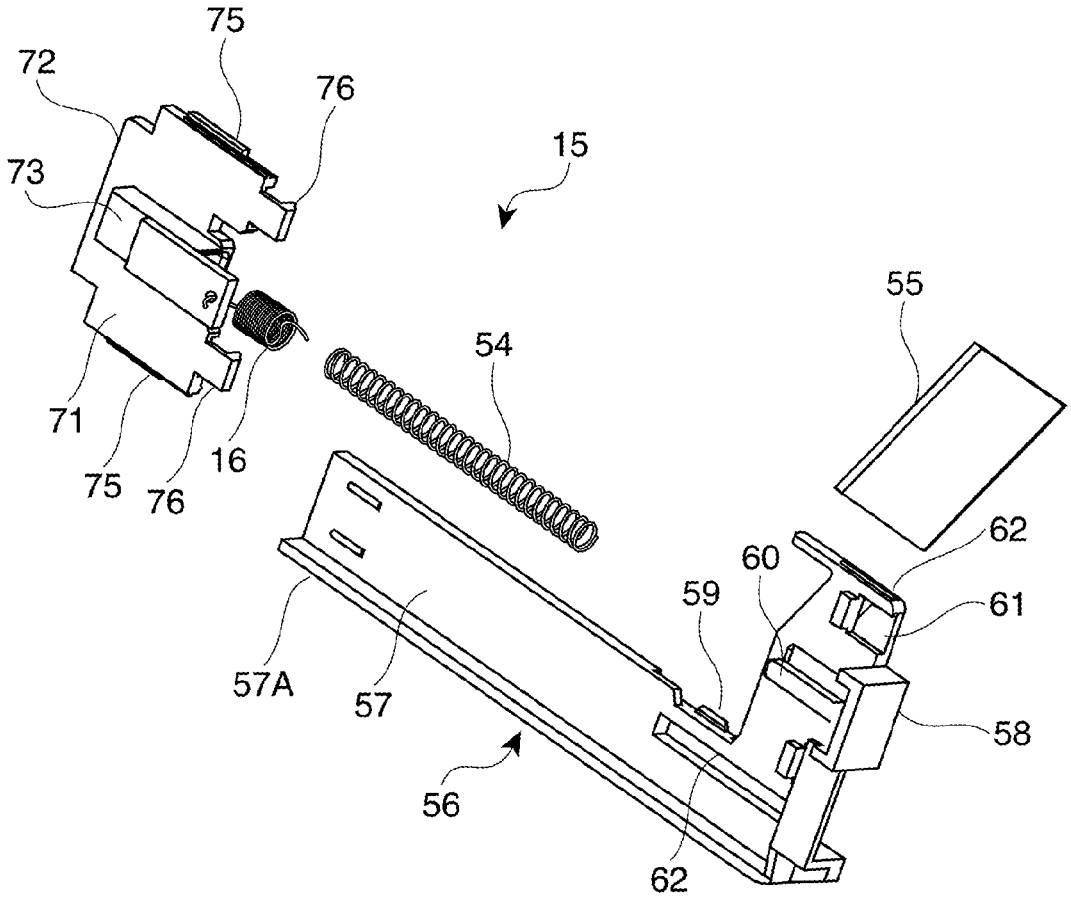
FIG. 7 is a perspective view of the slide cutter in a disassembled condition.

As illustrated in FIGS. 6A and 6B and 7, the slide cutter 15 has the cutter blade 55 which cuts the printing tape T, and a cutter holder 56 which holds the cutter blade 55. The slide cutter 15 is attached to the cutter frame 51 via the cutter holder 56 in such a condition as to freely slide. The tape pressing member 53 is attached to the cutter holder 56 in such a condition as to freely slide while urged by the coil spring 54.

The cutter holder 56 is a one-piece component having an L-shaped holder main body 57 which holds the cutter blade 55 provided at the tip of the holder main body 57, a holder base 57A connected with the lower end of the holder main body 57 to hold the holder main body 57, and the engaging projection 18 projected from the middle of the root of the holder main body 57. According to this structure, the cutter blade 55 is attached to the inside (cartridge attachment portion 8 side) at the tip of the holder main body 57, while the tape pressing member 53 and the coil spring 54 are attached to the outside (tape outlet port 10 side) thereat. A switch butting portion 58 against which the detection switch 17 butts is extended from the tip of the holder main body 57.

A pair of upper and lower holding projections 59 are provided on the inner surface of the tip of the holder main body 57. These holding projections 59 project toward the opposite projections to hold the cutter blade 55. The cutter blade 55 is attached to the holder main body 57 in such a manner that the cutter blade 55 is inserted between the pair of the holding projections 59 from the cam side. The cutter blade is constituted by an oblique blade which has a parallelogrammic thin-plate shape inclined at 65 degrees, and attached in such a condition that the blade edge facing to above points to the cam side.

On the other hand, a horizontal pin 60 is provided on the outer surface of the tip of the holder main body 57. The horizontal pin 60 located in the middle of the outer surface projects from the rear surface of the switch butting portion 58 to hold the coil spring 54. A pair of slide regulating grooves 61 are formed above and below the horizontal pin 60 such that the horizontal pin 60 is sandwiched between the slide regulating grooves 61. These slide regulating grooves 61 regulate the sliding position of the tape pressing member 53. Moreover, a pair of upper and lower sliding projections 62 are provided outside the slide regulating grooves 61. These sliding projections 62 contact the cutter frame 51 and slide there along.

In association with the structure of the cutter holder 56, the tape pressing member 53 has a one-piece structure constituted by a pressing member main body 71, a tape pressing surface 72 provided on the cam side of the pressing member main body 71, a spring housing 73 projecting from the middle of the pressing member main body 71, a spring receiving portion 74 to which the return spring 16 is hooked, a pair of slide engaging portions 75 provided at the upper and lower ends of the pressing member main body 71, and a pair of upper and lower hook portions 76 extended in the horizontal direction from the pressing member main body 71 toward the switch butting portion 58.

According to this structure, the pair of the hook portions 76 of the tape pressing member 53 engage with the pair of the slide regulating grooves 61 of the holder main body 57 in such a condition as to freely slide. Also, the pair of the slide engaging portions 75 engage with upper and lower guide grooves (not shown) formed in the cutter frame 51 in such a condition as to freely slide. In the condition of these engagements, a half of the coil spring 54 held by the horizontal pin 60 is inserted into the spring housing 73 with a press of the coil spring 54 applied against the spring housing 73.

The tape receiving member 52 of the cutter frame 51 faces to the tape pressing member 53 with the printing tape T sandwiched between the tape receiving member 52 and the tape pressing member 53. When the cutter holder 56 is drawn (advances) by the cutting cam 14, the tape pressing member 53 (tape pressing surface 72) initially presses the printing tape T against the tape receiving member 52 prior to the cutting by the cutter blade 55. During further advance of the cutter holder 56, the tape pressing member 53 keeps pressing the printing tape T while sliding relative to the cutter holder 56 and resisting the spring force of the coil spring 54 (compressing the coil spring 54). On the other hand, the cutter blade 55 advances and cuts the printing tape T in this condition.

After completion of the cutting of the printing tape T, the cutter holder 56 and the cutter blade 55 start retreating by the spring force of the coil spring 54. When the cutter holder 56 reaches the final step of retreat, the pair of the hook portions 76 of the tape pressing member 53 come into engagement with the cutter holder 56. Then, the tape pressing member 53 retreats together with the cutter holder 56 by the spring force of the return spring 16 to shift away from the printing tape T after cutting. When the cutter holder 56 reaches the standby position (home position), the switch butting portion 58 contacts the detection switch 17 and turns on the detection switch 17.

According to this embodiment, the return spring 16 of the tape cutting mechanism 11 is attached to the tape pressing member 53. In this case, the driving stroke of the tape pressing member 53 decreases. More specifically, the slide cutter 15 initially returns to the position engaging with the tape pressing member 53 by the spring force of the coil spring 54 after cutting of the printing tape T. Then, the tape pressing member 53 returns to the standby position by the spring force of the return spring 16. This structure not only reduces the driving stroke of the tape pressing member 53, but also produces the practical junction between the coil spring 54 and the return spring 16 in series. Accordingly, the torque necessary for driving the slide cutter 15 decreases in the driving motor 41.

According to the embodiment disclosed herein, the tape cutting mechanism 11 included in the tape printer 1 is a draw-cut type tape cutting mechanism. However, a press-cut type tape cutting mechanism may be incorporated in the tape printer in place of the draw-cut type tape cutting mechanism 11.

What is claimed is:

1. A tape cutter comprising:

a cutter for cutting a tape-shaped material;

a cutter frame for supporting the cutter in such a condition that the cutter can carry out cutting;

a cutter driving mechanism for allowing the cutter to perform cutting from a standby position to a cutting position;

a tape pressing member for pressing the tape-shaped material in a cutting direction against a receiving member provided on the cutter frame prior to the cutting by the cutter;

a pressing spring disposed between the cutter and the tape pressing member to urge the cutter and the tape pressing member in directions away from each other; and a return spring whose one urging end is hooked to the tape pressing member to return the cutter from the cutting position to the standby position by returning the tape pressing member.

2. The tape cutter according to claim 1, wherein the cutter includes a cutter blade, and a cutter holder which holds the cutter blade while supported by the cutter frame in such a condition as to freely slide in the cutting direction.

3. The tape cutter according to claim 2, wherein the tape pressing member is supported by the cutter holder in such a condition as to freely slide in the cutting direction.

4. A tape printer comprising:

the tape cutter according to claim 1; and a printing unit disposed on the upstream side in the feed direction of the tape-shaped material with respect to the tape cutter to perform printing on the tape-shaped material.

5. A tape printer comprising:

the tape cutter according to claim 2; and a printing unit disposed on the upstream side in the feed direction of the tape-shaped material with respect to the tape cutter to perform printing on the tape-shaped material.

6. A tape printer comprising:

the tape cutter according to claim 3; and a printing unit disposed on the upstream side in the feed direction of the tape-shaped material with respect to the tape cutter to perform printing on the tape-shaped material.

* * * * *